United States Patent [19]

Kline

[11] 4,040,323

[45] Aug. 9, 1977

[54] SYNTHETIC MATERIAL DRUMSTICK

[76] Inventor: Gregory G. Kline, 1437 W. Philadelphia, York, Pa. 17404

[21] Appl. No.: 656,960

[22] Filed: Feb. 10, 1976

[51] Int. Cl.[2] ..... G10D 13/00

[52] U.S. Cl. ..... 84/422 S

[58] Field of Search ..... 84/422 S, 452 P, 422 R

[56] References Cited

U.S. PATENT DOCUMENTS

| | | | |
|---|---|---|---|
| 2,521,336 | 9/1950 | Bramson | 84/422 S |
| 3,489,052 | 1/1970 | Colyer et al. | 84/422 S |

*Primary Examiner*—Stephen J. Tomsky
*Attorney, Agent, or Firm*—C. Hercus Just

[57] ABSTRACT

A synthetic material drumstick of the type commonly employed in the playing of various percussion instruments such as drums, cymbals, and the like, wherein the drumstick is fabricated from fiberglass reinforced polyester resin rod stock material machined to a specified dimensional configuration, which configuration, in combination with the material employed, provides a drumstick of significantly high durability characteristics.

2 Claims, 3 Drawing Figures

SYNTHETIC MATERIAL DRUMSTICK

BACKGROUND OF THE INVENTION

The present invention relates to a drumstick of the type commonly employed as a means to strike various percussion instruments such as drums, cymbals, and the like.

Normally, drumsticks are employed in pairs, and it is important that when so employed a pair of drumsticks be matched with regard to their weight, balance, and tone producing characteristics, as well as being linearly straight and true. In addition, drumsticks should primarily be durable in the respect that repeated impacts in use will not result in damage thereto when employed in the manner intended. Secondly, drumsticks should be stable with regard to dimensional as well as resilient rebound characteristics from the head of a percussion instrument so that the sound-producing mechanism generated by the impact of a drumstick therewith will be enhanced and not dampened by the striking. Thirdly, the drumstick should be maneuverable with regard to rapid facility by the user in respect to handling characteristics.

Traditionally, drumsticks have been fabricated from various moods which are readily available, relatively inexpensive and easily worked, as well as having proven to be suitable in the respect of providing acceptable resilient rebound and handling characteristics, but, however, unsuitable in respect of durability in that wooden drumsticks tend to chip and crack over a relatively short period of use, as well as not being stable in the respect that wooden drumsticks warp with changes in temperature and humidity, in addition to the fact that wooden drumsticks are also difficult to match with regard to weight, balance, and tone producing characteristics.

In an effort to maintain handling characteristics and yet at the same time enhance durability and stability features, various disclosures teach the employment of combinations of wood and non-wood materials in the fabrication of drumsticks, such as those exemplified by the plastic and wood combinations taught in U.S. Pat. No. 3,175,450 to Criscuolo dated Mar. 30, 1965, and U.S. Pat. No. 3,730,570 to Brochstein dated May 1, 1973. However, in both of the aforementioned disclosures, although the drumsticks shown therein teach improvements over a wooden drumstick per se, the respective durabilities and stabilities thereof are necessarily limited by that of the wooden component of the combinations.

Additionally, non-wood material combinations have been taught in the fabrication of drumsticks in an effort to overcome the aforementioned limitations inherent to a wooden component drumstick, such as the metal and plastic drumstick combinations exemplified in U.S. Pat. No. 3,146,659 to Robba et al dated Sept. 1, 1964; U.S. Pat. No. 3,165,964 to Stys et al dated Jan. 19, 1965; and in U.S. Pat. No. 3,489,052 to Colyer et al dated Jan. 13, 1970. Although these disclosures teach improved drumsticks over the aforementioned plastic and wood combination drumsticks, the methods of producing the same necessarily require more complicated and expensive manufacturing operations than are otherwise required in producing either a wooden drumstick or a drumstick embodying the principles of the present invention.

Other disclosures teach the use of non-wood materials which may or may not be employed in combination in the fabrication of drumsticks, such as the use of a synthetic resin having textile fibers embedded therein to form a drumstick having a bore in the shaft thereof which is packed with an acoustical foam material as exemplified in U.S. Pat. No. 3,147,660 to Brilhart dated Sept. 8, 1964, or as exemplified in U.S. Pat. No. 3,301,119 to Gilbert dated Jan. 31, 1967, showing the use of tapered tubular aluminum to form a drumstick per se with threaded or press fit affixment of an aluminum head thereto. However, the methods of producing the same necessarily require more complicated and expensive manufacturing operations than are otherwise required in producing either a wooden drumstick or a drumstick embodying the principles of the present invention.

The shortcomings and limitations set forth in teachings of the previous disclosures are obviated by a drumstick comprising the present invention, and a substantially improved, simply produced, and relatively inexpensive drumstick of increased durability is provided, the details of which are set forth hereinafter.

SUMMARY OF THE INVENTION

It is the principal object of the present invention to provide a synthetic material drumstick which exhibits significantly improved durability, dimensional and weight stability, and maneuverability characteristics over any other drumstick disclosures heretofore set forth in the prior art.

It is another object of the present invention to provide a drumstick posessing weight, balance, and matching characteristics which will enable the satisfactory employment thereof in the multiple use applications as either a trap drumstick, a rudimental drumstick, or a practice-pad drumstick, thereby eliminating the necessity for having three different sets of drumsticks for three different basic drumstick use applications.

A further object of the present invention is to provide a drumstick having a density and weight greater than that of conventional trap drumsticks, thereby providing for a quicker and more resilient rebound off the heads of trap drums and cymbals, and also thereby delivering a cleaner and clearer drum head sound and brassier cymbal effect.

An additional object of the present invention is to provide a drumstick which delivers excellent tone when struck upon a drum rim or upon another drumstick of the same material, without the danger of damage or breakage to either the instrument rim or the respective drumsticks.

Still another object of the present invention is to provide a drumstick which is economically and easily produced from a relatively inexpensive synthetic material by employing standard machining operations.

Details of the foregoing objects and of the invention, as well as other objects thereof, are set forth in the following specification and illustrated in the accompanying drawings comprising a part thereof.

DETAILED DESCRIPTION

Figure 1:
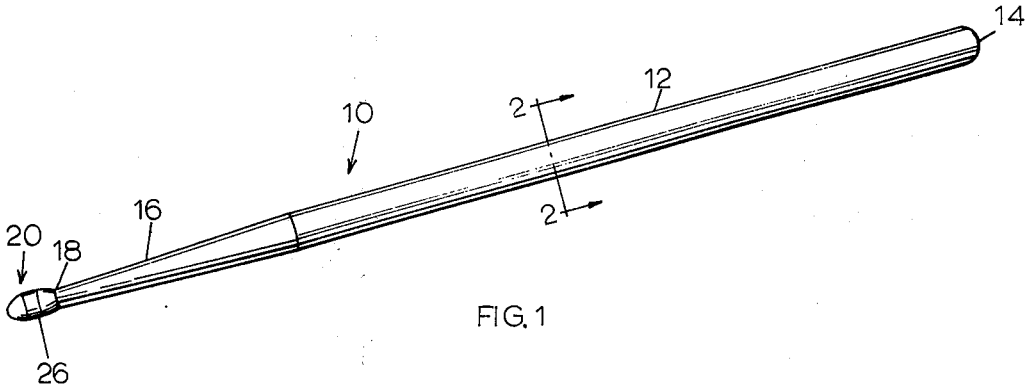
FIG. 1 is a perspective view of a drumstick embodying the principles and features of the present invention.

Referring to FIG. 1, a synthetic material drumstick 10 embodying the principles of the present invention is shown, said drumstick 10 having as respective integral component parts thereof a cylindrical shaft portion 12 terminating at one longitudinal end in a rounded butt portion 14 and at the other longitudinal end thereof having a tapered conical portion 16 leading to a neck 18 which supports an enlarged integrally formed terminating head portion 20, wherein the entire drumstick structure is produced from a continuous reinforced rod of synthetic material cut to longitudinal size and then machined to shape.

Also referring to FIG. 1, to further explain the details of this invention, there is provided a drumstick having significantly improved durability characteristics in addition to improvements in the other desirable drumstick characteristics heretofore enumerated and as hereinafter more fully set forth. The improved durability characteristics and other features of the drumstick comprising the present invention derive primarily from two factors, the first being the nature of the synthetic material from which the drumstick is fabricated and the second being the specific dimensional configurations of the drumstick comprising the present invention.

Figure 2:
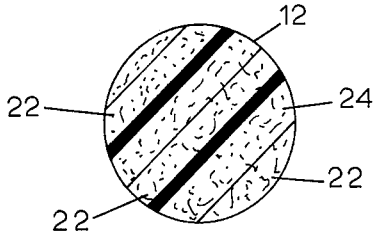
FIG. 2 is a cross-sectional view of the drumstick shaft as seen along the line 2—2 of FIG. 1.

For best results the preferred material from which to fabricate the drumstick of the present invention is fiberglass reinforced polyester resin rod stock, a cross-sectional view of which is illustrated in FIG. 2, the same being a material exhibiting extremely high durability characteristics resultant from a well dispersed random distribution of reinforcing fiberglass strands or rovings 22 within the polyester resin component 24 of the rod stock body. The preferred material further exhibits very good stability and resilience characteristics, in addition to being readily available from commercial sources, being relatively inexpensive, and readily machinable by standard grinding methods into the disclosed drumstick configuration as hereinafter more fully described and explained. It should be understood, however, that any other suitable material having similar durability, stability, and resilience characteristics to that of fiberglass reinforced polyester resin rod stock may be equally well employed.

The form of the invention actually reduced to practice was made from rod stock having a compression strength of 29,000 P.S.I., a tensile stress of 20,000 P.S.I., and a flexible strength of 38,000 P.S.I.. It furnished a drumstick having an overall longitudinal dimension of 16 inches with said foregoing strength characteristics. It should be understood, however, that the overall longitudinal dimension per se of the drumstick of the present invention is not in itself critical to obtaining the features provided, and decreases or increases of ½ inch increments to furnish overall longitudinal drumstick dimensions of from 15 to 18 inches are contemplated, and that the 16 inch drumstick dimension herein described is illustrative only of the concept of the present invention and is not to be regarded as dimensionally restrictive thereto. Similarly, the transverse dimension of the fiberglass reinforced polyester resin rod stock material comprising the cylindrical drumstick shaft is shown as ½ inch, which for purposes of further describing the inventive concept herein disclosed primarily is illustrative only and likewise is not to be regarded as exactly dimensionally restrictive thereto. With the foregoing in mind, reference now is made to FIG. 3 to explain the dimensional configuration aspects of the present invention.

Figure 3:
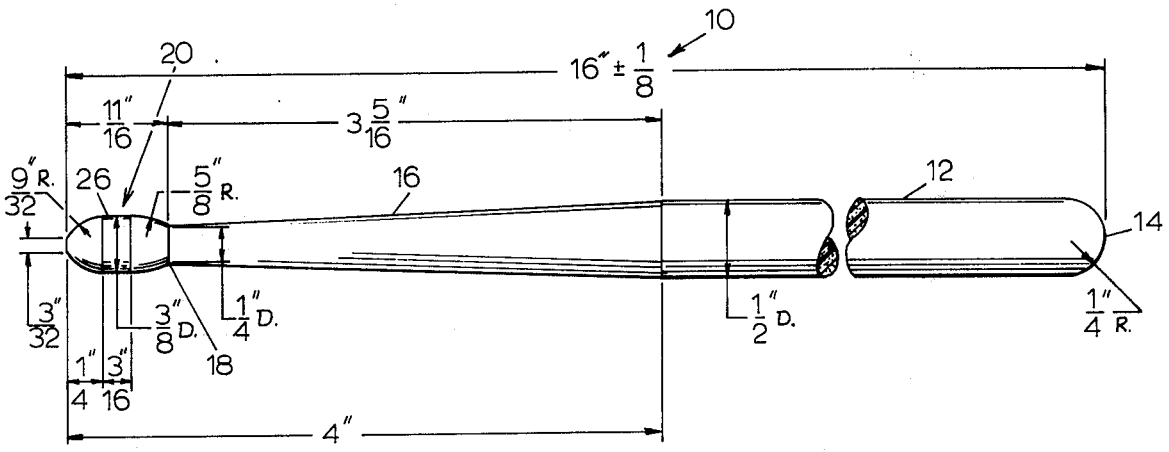
FIG. 3 is an enlarged foreshortened plan view of the drumstick as seen in FIG. 1, showing in dimensional detail the head, neck, and shoulder portions thereof.

The view shown in FIG. 3 illustrates two types of dimensions for the drumstick comprising the present invention, one set of which specifies the longitudinal dimensional relationships of the various drumstick components, and the other set of which specifies the transverse dimensional relationships of the various drumstick components, which dimensional relationships it has been determined are necessary in order to obtain the improved durability and other enumerated features thereof when a drumstick of the present invention is fabricated from the preferred material.

As shown in FIG. 3, the overall longitudinal dimension of the drumstick 10 is 16 inches with a tolerance of plus or minus ⅛ inch. The longitudinal dimension of the tapered conical shoulder portion 16 is 3 5/16 inches, and the longitudinal dimension of the head portion is 11/16 inch, which provides a handle comprised of the cylindrical shaft portion 12 having a longitudinal dimension of 12 inches. Therefore, the longitudinal dimensions of the tapered conical shoulder 16 and head 20 portions of the drumstick 10 are, in combination, substantially one fourth that of the overall longitudinal dimension of the drumstick 10.

It will further be noted that the transverse dimension of the handle, comprising the cylindrical shaft portion 12 of the drumstick 10, has a uniform diameter of ½ inch over the longitudinal dimension thereof; that the neck portion 18 of the drumstick 10 is circular in cross-section and has a diameter of ¼ inch; and further, that the central portion 26 of the head or tip 20 of the drumstick 10 is uniformly cylindrical in shape and has a diameter of ⅜ inch and a length of 3/16 inch, whereby the tip is approximately twice as long as the diameter thereof. Therefore, the diameter of the circular neck portion 18 of the drumstick 10 is substantially one-half that of the diameter of the handle comp ised of the cylindrical shaft portion 12 of the drumstick 10, and the diameter of the uniformly cylindrical central portion 26 of the head 20 of the drumstick 10 is substantially three-fourths that of the diameter of said handle and the length of said portion 26 is approximately one-fourth the length of the tip 20. The terminal end of the tip beyond the cylindrical central portion 26 is rounded on a radius of 9/32 inch, as clearly shown in FIG. 3, and between the opposite end of said cylindrical central portion 26 and the neck 18, there is a rounded tapering surface having a radius of ⅝ inch as clearly shown in FIG. 3. Also, the outermost surface of the terminal end of tip 20 is flat and of the very small diameter of 3/32 inch, the same being perpendicular to the axis of the drumstick 10.

Other dimensional features of the drumstick 10 to be noted are those of the head 20 as detailed and set forth in FIG. 3, in addition to the dimensional configuration of the rounded butt portion 14 as also shown, and also the fact that the conical shoulder 16 is uniformly tapered from the base thereof beginning from the cylindrical shaft end and terminating at the neck 18 of the drumstick 10.

As previously indicated, it has been determined that a combination of the aforementioned longitudinal and transverse dimensional relationships of the drumstick 10 further provides enhanced durability features when the same are applied to rod stock of the preferred material in fabricating said drumstick, without diminishing the other aforementioned desirable features also obtained by the present invention.

With respect to durability, a series of impact tests were conducted employing a 10 pound hammer, wherein a 16 inch drumstick fabricated in accordance with the principles of the present invention was positioned upon a hard horizontal surface head down and held at an angle of 45° to said surface, and then successively struck 10 times with said hammer at respective elevations of 2 inches, 4 inches, and 6 inches above said head, which test was then repeated at angular positions of 30° and 15°. The aforementioned test series was then repeated with said drumstick being held in a butt down position. It should be noted that the same drumstick was employed in conducting the entire aforementioned test series, and other than for a slight marring of the surface of said drumstick at the points of impact by the hanner, there was no discernible damage thereto. The same test conducted with wooden drumsticks resulted in the sticks being broken upon the first to third impacts. The following table details the results of the aforementioned series of tests, wherein the drumstick of the present invention is designated as GGK-16:

| Type of Drumstick | Position: Head Down | Position: Butt Down | Angle (Degrees) | Elevation of Impact (Inches) | Number. of Impacts | Broke: Yes | Broke: No |
|---|---|---|---|---|---|---|---|
| Wooden, Model 5A Pro-Mark | X | | 45 | 2 | 1 | X | |
| Wooden, Model 3S | | X | 45 | 2 | 3 | X | |
| GGK-16 | X | | 45 | 2,4, & 6 | 10 each | | X |
| GGK-16 | X | | 30 | 2,4, & 6 | 10 each | | X |
| GGK-16 | X | | 15 | 2,4, & 6 | 10 each | | X |
| GGK-16 | | X | 45 | 2,4, & 6 | 10 each | | X |
| GGK-16 | | X | 30 | 2,4, & 6 | 10 each | | X |
| GGK-16 | | X | 15 | 2,4, & 6 | 10 each | | X |

As can be seen, the test results set forth in the Table above clearly indicate the improved durability characteristics and features of a drumstick embodying the principles of the present invention.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A synthetic material drumstick formed from solid polyester resin reinforced with glass roving fibers, said drumstick having a butt end and a substantially straight cylindrical portion forming a handle extending forward from said butt end approximately three-fourths the length of said drumstick, the opposite end of the drumstick comprising a head end integrally extending forward from the end of the handle opposite the butt end thereof approximately one-fourth the length of said drumstick, said head end being substantially in the form of a straight elongated truncated conical section terminating in a neck integrally connected to a tip on the forward end of said head, the neck of said truncated conical portion being substantially one-half the diameter of said handle, and said tip having an intermediate cylindrical portion substantially three-quarters the diameter of said handle and has a length approximately one-fourth that of said tip, the outer end of said tip being smoothly rounded and the portion of said tip between said intermediate cylindrical portion and said neck being tapered in a smoothly rounded shape.

2. A synthetic material drumstick according to claim 1 wherein the smoothly rounded portions of said tip at the opposite ends of said intermediate cylinder portion of the tip are substantially equal in length.

* * * * *